US005502915A

United States Patent [19]

Mendelsohn et al.

[11] Patent Number: 5,502,915

[45] Date of Patent: Apr. 2, 1996

[54] GUN

[75] Inventors: Eddie S. Mendelsohn, 6117 Pontiac St., San Diego, Calif. 92115; Robert Hotto, La Jolla, Calif.; Shlomo Caspi, San Diego, Calif.

[73] Assignee: Eddie S. Mendelsohn, San Diego, Calif.

[21] Appl. No.: 235,680

[22] Filed: Apr. 29, 1994

[51] Int. Cl.[6] ..... F41C 17/06

[52] U.S. Cl. ..... 42/70.11

[58] Field of Search ..... 42/70.01, 70.11, 42/84, 66

[56] References Cited

U.S. PATENT DOCUMENTS

| | | | |
|---|---|---|---|
| 4,003,152 | 1/1977 | Barker et al. | 42/70.01 |
| 4,354,189 | 10/1982 | Lemelson | 42/70.11 |
| 4,467,545 | 8/1984 | Shaw | 42/70.01 |
| 4,488,370 | 12/1984 | Lemelson | 42/70.11 |
| 4,682,435 | 7/1987 | Heltzel | 42/70.01 |
| 4,970,819 | 11/1990 | Mayhak | 42/70.01 |
| 5,062,232 | 11/1991 | Eppler | 42/70.11 |
| 5,168,114 | 12/1992 | Enget | 42/70.01 |
| 5,192,818 | 3/1993 | Martin | 42/70.01 |
| 5,303,495 | 4/1994 | Harthcock | 42/84 |

*Primary Examiner*—Charles T. Jordan

*Attorney, Agent, or Firm*—Ellsorth R. Roston; Charles H. Schwartz

[57] ABSTRACT

A programmable gun has a body supporting a handle, a trigger and a pin actuatable between a first position providing for a trigger depression to fire a bullet and a second position restraining the trigger depression. A memory stores a print identifying an authorized person's hand when such person inserts a key in the handle and then grips the handle. Hand prints of one (1) or more authorized persons, or several hand prints of one (1) person, may be stored in the memory when such persons move the key, after insertion, to individual positions and then grip the handle. When an authorized person thereafter grips the handle, that person's hand generates a print for comparison with the prints in the memory. A comparison coincidence produces a pin actuation to the first position. A subsequent gun firing is recorded in the memory as to time and as to the authorized person. When a comparison coincidence is established, the ability to fire the gun continues until such authorized person relinquishes the gun. If the authorized person relinquishes the gun before firing, the pin becomes actuated to the second position after a particular time period. If the authorized person again grips the handle during such particular time period, the time period is re-initiated. When an unauthorized person grips the handle, no comparison coincidence occurs and the pin is not actuated to the first position. A print of such unauthorized person's hand and the recording time are recorded in the memory.

63 Claims, 6 Drawing Sheets

GUN

This invention relates to a gun programmable to limit the firing of the gun only to a limited number of authorized persons. More particularly, the invention relates to a gun which compares the hand prints of proposed users with the hand prints stored in a memory in the gun of authorized persons and which provide for a firing of the gun only in accordance with a coincidence in such comparison.

The use of guns has proliferated in recent years. Every day in the newspapers or on television, there is a grisly story of individuals running rampant and firing guns indiscriminately into groups of people and killing some and injuring others. The situation has deteriorated so significantly that youngsters in their teens and even younger now commonly kill fellow students at school. Furthermore, large cities, and now even small cities, have gangs of youngsters who wage war on one another and kill members of rival gangs and even innocent bystanders.

Many citizens are buying guns to protect themselves. For example, in 1993 gun sales increased by approximately twenty percent (20%) in California. The proliferation of guns increases the potential for their unauthorized use. As gun owners, parents are afraid that their children will attempt to operate guns on an unauthorized basis. Homeowners are afraid that a criminal unlawfully entering into their home will make unauthorized use of their gun. This is a common occurrence today as evidenced by many news reports.

In view of the above, there is a growing consensus that steps have to be taken in an attempt to reduce and even minimize the killings that are occurring through gun shootings. For example, legislation is now pending to permit a sale of a firearm to an individual only after a waiting period such as fifteen (15) days. The hope is apparently that an investigation can be made of the individual during this waiting period to determine if a sale is justified.

Various attempts have been made from a technological standpoint to limit the firing of guns only by authorized persons. For example, a gun has been suggested or provided which uses a keypad and a decoder system. This gun requires a proposed user to enter a code into the decoder system. The gun is enabled to be fired only when the number entered into, and the number stored in, the decoder system coincide. As will be appreciated, this system is disadvantageous because there is a considerable time delay while the proposed user is entering the code into the decoder. During this time delay, the proposed user may be in considerable danger.

Another gun has been provided or suggested which also provides an active participation by the user before the gun can be fired. This system requires the user to wear a special ring which transmits a coded signal to the gun. This is illustrated in U.S. Pat. No. 5,016,376. This signal is decoded by a safety system in the gun. The gun is operated only when the proper signal or series of signals are transmitted to the safety system in the gun. The system involves an active participation by the gun user because the user has to wear the special ring. The system is also disadvantageous because the gun has to have a battery and the battery tends to lose its power with time.

A number of other systems have been proposed in recent years to regulate the operation of a weapon such as a gun. All of such systems operate on an active basis which requires some participation by the proposed user other than merely to operate the gun. These requirements for active participation by the proposed user are disadvantageous because they either require a delay in time or some other event (such as the wearing of a ring) to occur before the gun can be operated.

Although a considerable amount of attention has been devoted in recent years to providing a gun which limits and regulates the use of the gun only to selective persons, the problem still exists. No gun has been provided or suggested which regulates the use of the gun effectively on a passive basis and which can be used instantaneously after an authorized user grips the gun.

This invention provides a gun which effectively limits or regulates the use of the gun on a passive basis so that only authorized users can fire the gun on an instantaneous basis after such authorized user has gripped the gun. The gun of this invention pre-records a print of an authorized user's hand in a memory. When the authorized user thereafter grips the gun, the print of the authorized user's hands on the gun handle is compared with the stored print of the authorized user's hand. A coincidence in such comparison allows the gun to be operated instantaneously after the gun has been gripped by the authorized user.

In one embodiment of the invention, a programmable gun has a body supporting a handle, a trigger and a pin actuatable between a first position providing for a trigger depression to fire a bullet and a second position restraining the trigger depression. A memory stores a print identifying a hand of an authorized person when such person inserts a key in the handle and then grips the handle. Hand prints of several authorized persons may be stored in the memory when such persons move the key, after insertion, to individual positions and then grip the handle.

When an authorized person thereafter grips the handle, that person's hand generates a print for comparison with the prints in the memory. A comparison coincidence produces a pin actuation to the first position. A subsequent gun firing is recorded in the memory as to time and as to the authorized person. When a comparison coincidence is established, such coincidence continues thereafter while such person grips the handle. The pin remains actuated in the first position during this time. The comparison coincidence continues even after the user fires the gun.

If the authorized person relinquishes the gun before firing, the release of the membrane switch 20 is sensed and, after a particular period, the microprocessor causes the pin to be actuated to the second position. If the authorized person again grips the handle and depresses the membrane switch before the end of such particular time period, coincidence is re-established and the time period is reset. When an unauthorized person grips the handle, no comparison coincidence occurs and the pin is not actuated to the first position. A print of such unauthorized person's hand and the recording time are recorded in the memory.

Figure 1:
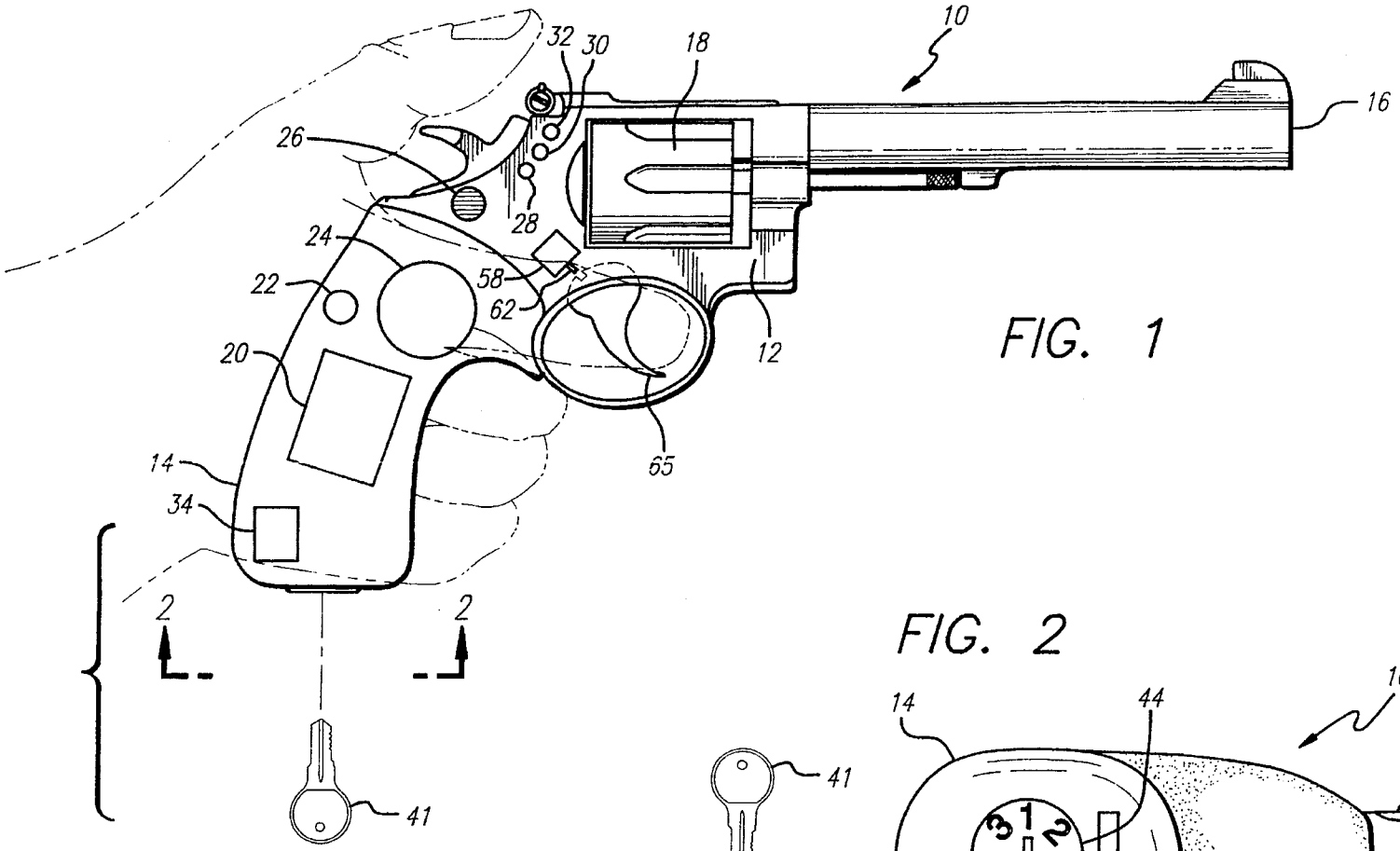
FIG. 1 is a schematic elevational view which shows a gun constituting one embodiment of the invention and which schematically shows the hand of a person gripping the gun to fire the gun.
Figure 2:
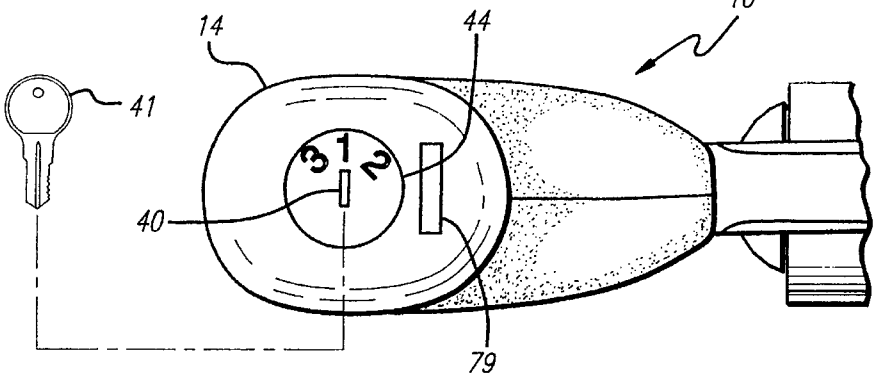
FIG. 2 is a bottom plan view of a handle which is included in the gun shown in FIG. 1.

In one embodiment of the invention, a gun generally indicated at 10 is provided in FIGS. 1 and 2. The gun 10 includes a body 12, a handle 14 integral with the body, a nozzle 16 with an opening for providing for the passage of bullets and a rotatable cartridge 18 for holding a plurality of bullets. The gun 10 as constructed above is known in the art and is considered only to be illustrative. It will be appreciated that different embodiments of a gun may be used without departing from the scope of the invention.

The gun 10 includes a sensing pad 20 which is disposed on the side of the handle 14 to receive a particular portion, such as the palm, of a person's hand when such person grips the handle as illustrated schematically in FIG. 1. When this occurs, the sensing pad 20 receives a print of a portion of the hand of the person gripping the handle 14. The print includes the swirls, and the grooves between the swirls, individual to the hand of such proposed user. A sensing pad such as the sensing pad 20 is well known in the art. For example, a suitable unit is available from Identix, Incorporated, of Sunnyvale, Calif.

A source of energy such as a battery 22 is also disposed in a socket in the handle 14. The battery 22 is disposed so that it is easily accessible and can be easily replaced when its energy has become depleted. A membrane switch 24 is also disposed in the handle 14 at a position where it is engaged by the hand of the person gripping the gun. The membrane switch 24 includes a membrane which is depressed when the user grips the handle of the gun. When the membrane in the switch 24 is depressed, it closes the switch. A switch such as the membrane switch 24 is known in the art.

Indicators are also disposed on the handle 14 or the body 12. For example, a buzzer 26 is shown in FIG. 1 as being disposed on the handle 14. The buzzer emits a distinctive sound when the gun 10 has been gripped by an authorized person and is ready to be fired. Illuminating means such as light-emitting diodes 28, 30 and 32 are disposed on the body near the handle. The diode 28 produces a green light when the gun 10 is ready to be fired. The diode 30 produces a red light when an unauthorized person grips the gun 10.

The diode 32 produces a flashing or blinking light when the gun is in a problem status other than being gripped by a non-authorized person. For example, the light 32 may flash when the gun has no bullet in the chamber. This may be accomplished by a sensor subsystem which indicates magnetically the presence of a bullet in a chamber. The disposition of the buzzer 26 and the diodes 28, 30 and 32 on the gun may be other than as shown in FIG. 1 without departing from the scope of the invention. Furthermore, the buzzer 26 and the diodes 28, 30 and 32 are illustrative only of the types of sensors and indicators that may be used.

Figure 5:
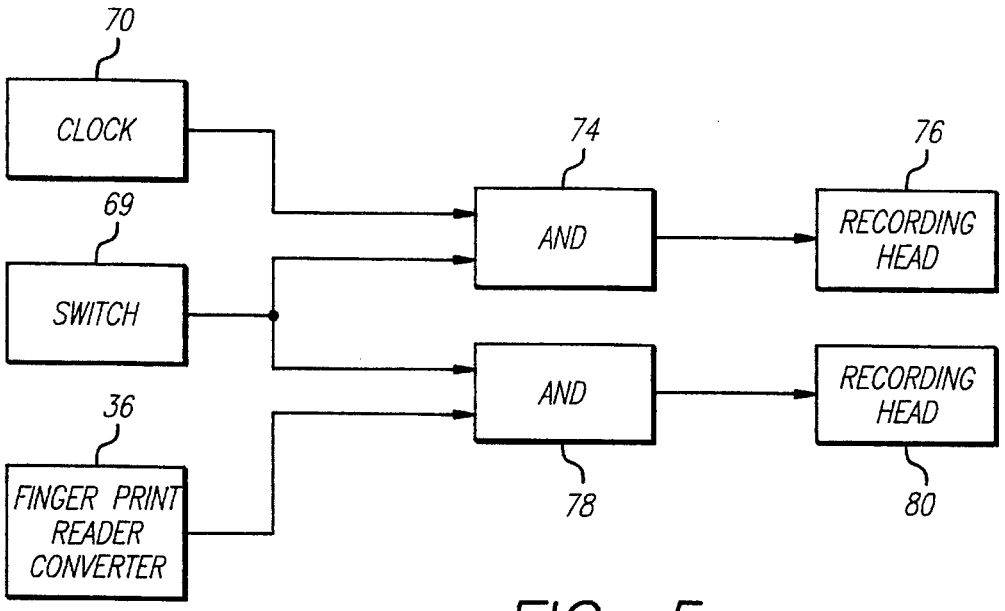
FIG. 5 is a schematic circuit diagram illustrating in block form how the hand print of a person firing the gun and the time of firing are recorded in a memory in the gun.
Figure 6:
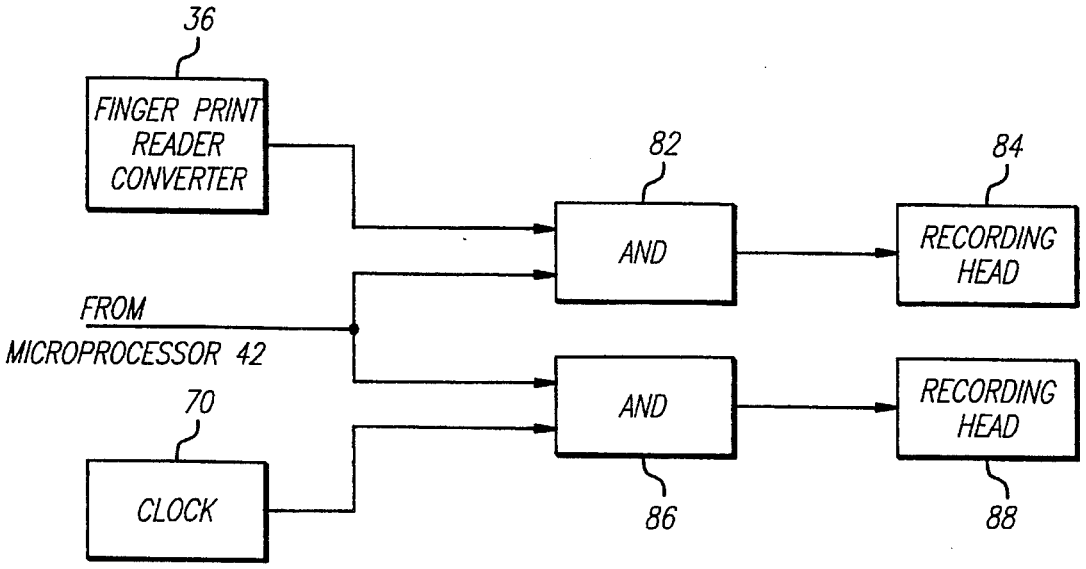
FIG. 6 is a schematic circuit diagram illustrating in block form how the hand print of an unauthorized person is recorded in the memory when that person tries to fire the gun and how the time of such attempt is also recorded in the memory.

A memory 34 (FIGS. 1, 3, 4 and 8) is disposed in the handle 14, which may be hollow, or in the portion of the body to the rear of the cartridge 18. The memory 34 may be constructed in a conventional manner. The memory 34 stores in binary form the characteristics such as the optical characteristics and pattern of the swirls and grooves individual to the portion of the hand of an authorized user on the sensing pad 20. This binary pattern is obtained by scanning the swirls and grooves in a conventional manner and by introducing the resultant signals to a finger print reader converter 36 (FIGS. 4, 5 and 6) which may be a digital-to-analog converter and which may be constructed in a conventional manner. The relative sizes of different elements such as the sensing pad 20 and the memory 34 are shown only schematically in the drawings and may not indicate the actual sizes of these elements.

The memory 34 may have sufficient capacity to store in binary form the hand prints of several authorized users. For example, FIG. 2 illustrates a slot 40 disposed at the bottom flat surface of the handle 14 for receiving a key 41. The key 41 and the slot 40 may respectively have corresponding male and female patterns in a conventional manner so that only the key 41 can fit in the slot 40. As shown in FIG. 2, the slot 40 is disposed in a key barrel 44 which is rotated by the key 41 to three (3) different positions. It will be appreciated that a different number of positions than three (3) may be provided without departing from the scope of the invention.

At each position in the key barrel 44, an authorized person may grip the handle 14 to have that person's print pattern recorded and stored in a different portion of the memory 34. This may be seen from FIG. 4 which shows how the signals from the sensing pad 20 are converted to a binary form by the converter 36 after passing through an OR network 83 and are directed in the binary form through an individual position in a three (3)-position switch 38 to an individual portion of the memory 34. The conversion of a hand print to a digital form as by the converter 36 and the passage of the converted information through a switch such as the switch 38 to a memory such as the memory 34 are well known in the art.

Figure 4:
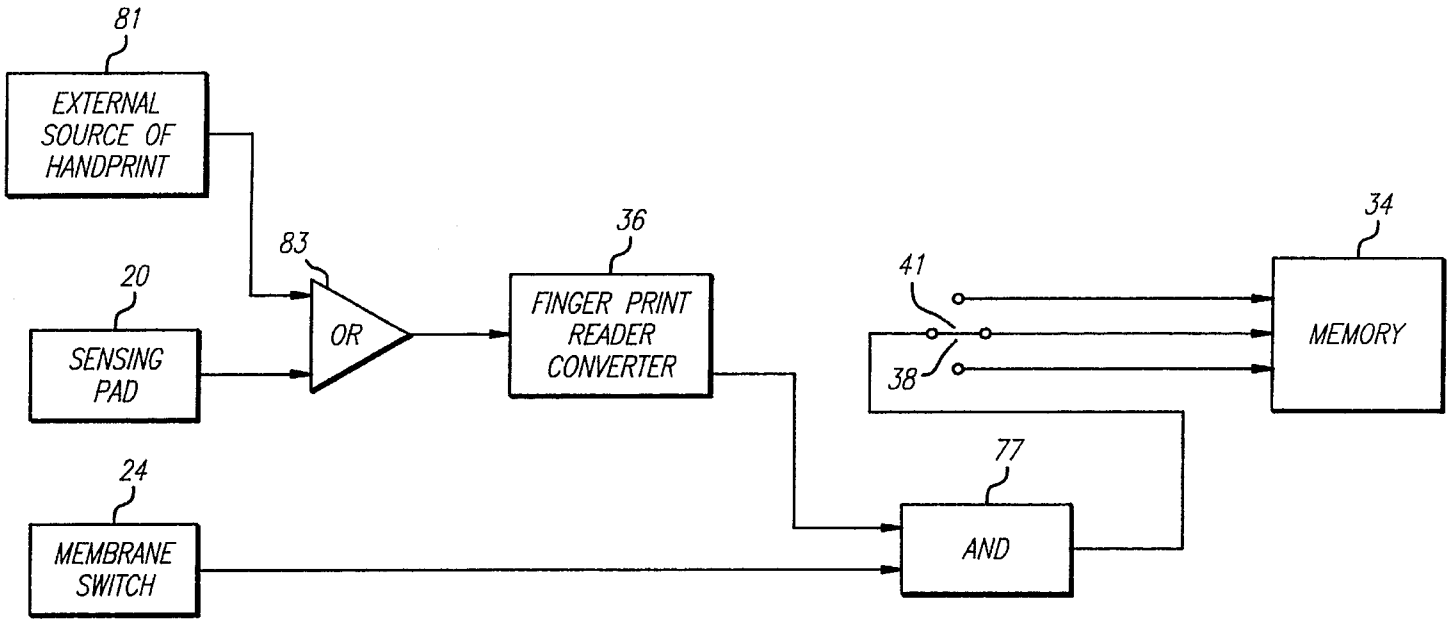
FIG. 4 is a circuit diagram in block form of the sensing and recording system included in the gun for providing a record in the memory in the gun of the hand print in the gun of an authorized person.

In FIG. 4, the digital signals from the converter 36 shown as being introduced to an AND network 77. These signals pass through the AND network 77 when the membrane switch 24 is closed. The digital signals passing through the AND network 77 activate the memory 34 so that the memory records the signals in the portion of the memory indicated by the setting of a movable arm 41 of the switch 38. The movable arm 41 may constitute the key 40 which engages individual stationary contacts of the switch in accordance with its rotational position in the barrel 44.

A receptacle 79 (FIG. 2) is provided for receiving a print of the particular portion of a person's hand from an external source 81 (FIG. 4). The hand print from the external source 81 passes through the OR network 83 to the converter 36. The resultant digital signals then pass through the AND network 77 and the switch 38 to the memory 34 when the membrane switch 24 is depressed and the key 40 is disposed in the barrel 44.

Figure 3:
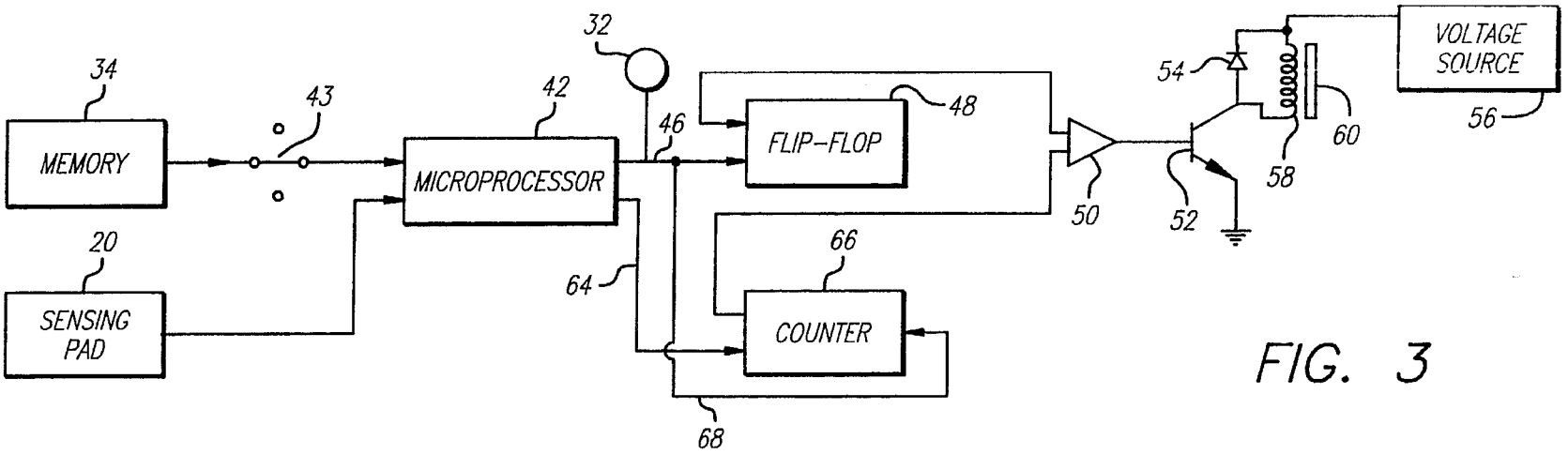
FIG. 3 is a schematic electrical diagram, partially in block form, of an electrical system included in the gun for providing for the firing of the gun only by authorized personnel.

After the hand prints of up to three (3) different persons have been recorded in digital form in the memory 34 to authorize these people to fire the gun 10, one of these authorized people may grip the handle 14. The sensing pad 20 then produces signals which are compared in a microprocessor 42 (FIG. 3) with the hand prints stored in the memory 34 for the three (3) authorized persons. This comparison may be on a sequential basis for such three (3)

individuals as by scanning successive portions of the memory 34. This is indicated in FIG. 3 by the introduction of the binary information from the memory 34 through a sequentially operated switch 43 to the microprocessor 42, the switch being operative sequentially operated through the different positions when the membrane switch 24 is depressed. The microprocessor 42 also receives the signals from the sensing pad 20. The construction and operation of a microprocessor such as the microprocessor 42 for providing a comparison are well known in the art. It will also be appreciated that the memory 34 may store the hand prints of more than three (3) authorized persons and that the key barrel 44 and the switch 43 may be moved to more than three (3) positions.

The microprocessor 42 senses whether the binary pattern for the hand print in the sensing pad 20 matches or coincides with the binary pattern stored in the memory 34 for the hand print of any one of the three (3) authorized persons. When such a coincidence occurs, the microprocessor 42 produces a signal on a line 46 in FIG. 3. This signal is introduced to the "true" input terminal of a flip-flop 48 in FIG. 3. The "true" output terminal of the flip-flop is connected to an input terminal of an OR network 50.

The output terminal of the OR network 50 is common with a gate of a transistor 52 which may be an n– type of CMOS transistor. The drain of the transistor 52 is connected to a reference such as ground. The source of the transistor 52 is common with the cathode of a diode 54 having its anode connected to a voltage source 56 for providing a positive potential and to one terminal of a solenoid 58. The other terminal of the solenoid 58 is common with the source of the transistor 52.

A solenoid for use as the solenoid 58 is illustratively manufactured by Guardian Electric Manufacturing Co. The solenoid 58 has a magnetizable armature 60 which operates as a magnetizable latching mechanism. The magnetizable latching mechanism enables a pin 62 (FIG. 1) to be latched in an individual one of two (2) separate positions upon each successive energizing of the solenoid 58. In a first position, the pin 62 releases a trigger 65 so that the trigger can be depressed to fire the gun. In the second position of the pin 62, the pin locks the trigger 65 (FIG. 1) against being depressed to fire the gun 10.

The microprocessor 42 (FIG. 3) compares the binary indications of the hand print in the sensing pad 20 and the binary indications in successive ones of the three (3) hand prints in the memory 34. When a coincidence occurs in this comparison, the microprocessor 42 produces a signal which triggers the flip-flop 48 to the true state. The resultant high voltage on the gate of the semiconductor 52 causes the semiconductor to become conductive and the solenoid 58 to become energized. The armature 60 accordingly moves to a position in which the pin 62 is latched in its first position. In this position, the trigger 65 is released so that it can be depressed to fire the gun. The green light 28 becomes illuminated at the same time as the release of the trigger 65 to indicate that the gun 10 is ready to be fired. The buzzer 26 may also be operated at this time.

The latching of the pin 62 to the first position as by the operation of the flip-flop 48 is advantageous since it minimizes any drainage of electrical power in energizing means such as a battery for the electrical circuitry. This energizing means may be the battery 22. This results from the fact that the flip-flop 48, being bistable, has to be operative only for an instant. It will be appreciated that the pin 62 may be operated by mechanical means instead of by the solenoid 58 without departing from the scope of the invention. A mechanical arrangement may be advantageous because it does not require electrical power for its operation.

The operation of the microprocessor 42 in determining a coincidence between the prints in the sensing pad 20 and the memory 34 is approximately only ninety six percent (96%) reliable. This reliability may be significantly increased by storing the same print in two (2) of the different positions in the memory 34. For example, when the same print is stored in two (2) of the three (3) positions in the memory 34, the reliability of the determinations from the microprocessor 42 increases to a value greater than ninety nine percent (99%). When the same print is stored in the three (3) positions in the memory 34, the reliability of the determination from the microprocessor 42 approaches one hundred percent (100%).

When a coincidence occurs between the prints in the sensing pad 20 and the memory 34, the microprocessor 42 continues to confirm this coincidence. It may sometimes happen, however, that the authorized person may lift his hand from the handle 14 or otherwise relinquish his grip on the handle. At such a time, the microprocessor 42 may produce a signal on a line 64. This signal is introduced to timing circuitry such as a counter 66.

The counter 66 is preset to count a particular period such as approximately twenty (20) seconds. If this period passes without a signal on the line 46, the counter 66 counts down to a value such as zero (0). At this count, the counter 66 passes a signal through the OR network 50 to the gate of the transistor 52. The resultant current through the transistor 52 energizes the solenoid 58 and causes the rod 60 to move the pin 62 to the second position. In this position, the pin 62 locks the trigger 65 and prevents the trigger from being depressed.

After the authorized user relinquishes the user's grip on the handle 14, the authorized user may subsequently grip the handle. When this occurs, a signal is again produced on the line 46 to indicate a coincidence between the prints in the sensing pad 20 and the memory 34. If this signal occurs while the counter 66 is still counting down to a value of zero (0), the signal resets the counter so that its value is reset to a full value such as twenty (20) seconds. The counter 66 is reset by a signal on a line 68 which coincides with the line 46.

The microprocessor 42 then continues to determine coincidence and maintains the count in the counter 66 at the full value of twenty (20) seconds upon a determination of coincidence. The pin 62 is also maintained in the first position so that the gun 10 is prepared to be fired. When the gun 10 is fired, the depression of the trigger 65 causes the firing to be recorded at a special position in the memory 34. For example, a switch 69 in FIG. 5 may be closed by the depression of the trigger 65. This may cause a clock 70 to pass signals representing time through an AND network 74 to a recording head 76 in the memory 34. The converter 36 also passes signals at this time through an AND network 78 to a recording head 80 to record the signals in the sensing pad 20.

It may sometimes happen that an unauthorized user grips the handle 14. When this occurs, the microprocessor 42 will produce a signal on the line 64 (FIG. 3) to indicate that no coincidence exists between the print in the sensing pad 20 and in the memory 34. When a signal is produced on the line 64, the print in the sensing pad 20 is converted to a digital form by the converter 36 in FIG. 4. The digital signals from the converter 36 pass through an AND network 82 (FIG. 6) to a recording head 84 which records in the memory 34 the binary pattern of the signals in the sensing pad 20, the AND network having been activated by the signal on the line 64.

The binary signals representing the hand print of the unauthorized user are recorded in a separate section of the memory 34. The time of such recording is also stored in the separate section of the memory 34 by the passage through an AND network 86 (FIG. 6) to a recording head 88 of binary signals representing the time in the clock 70, the AND network having been activated by the signal on the line 64. At the same time, the red light 30 is illuminated to indicate that the gun 10 is not ready to be fired.

Figure 7:
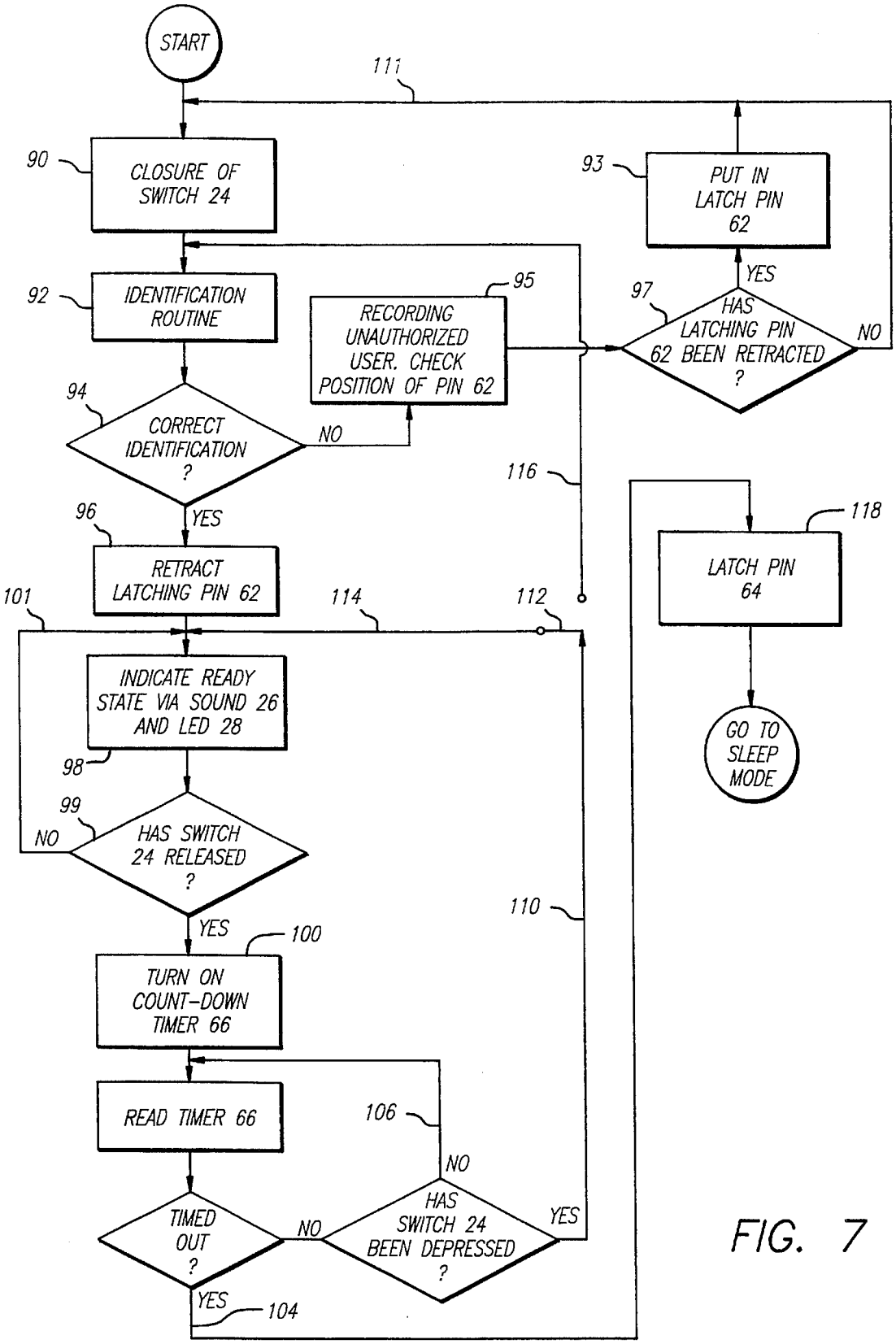
FIG. 7 is a flow chart showing the sequential steps in the operation of the gun.

FIG. 7 is a flow chart illustrating the sequence of operations in the gun 10. When the handle 14 of the gun 10 is gripped, the switch 24 is closed as indicated at 90 in FIG. 7. The coincidence between the prints in the sensing pad 20 and the memory 34 is then determined as indicated at 92 in FIG. 7. If a coincidence is not initially determined, a signal is provided in the microprocessor 42 to obtain another determination. This is indicated at 94 in FIG. 7. When this occurs, the print of the unauthorized user is recorded in the memory 34 and the position of the pin 62 is checked as indicated at 95 in FIG. 7.

If the pin 62 is latched in the first position as indicated at 97, the pin 62 is actuated to the second position for preventing the trigger 65 from being depressed, as indicated at 93 in FIG. 7. A signal is then provided on a line 111 to obtain another determination.

If the pin 62 is latched in the second position to prevent the trigger 65 from being depressed, a signal is provided on the line 111 to obtain another determination. If a coincidence is determined, the pin 62 is retracted to the first position as indicated at 96 in FIG. 7. The buzzer 26 and/or the light 28 are then energized as indicated at 98 in FIG. 7.

After the pin 62 has been retracted to the first position, the system continues to check the position of the membrane switch 24 as indicated at 99 in FIG. 7. If the membrane switch 24 has not been released, the pin 62 continues to be latched and the gun continues to be in a ready mode as indicated by the light emitting diode 28. This is indicated by a signal on a line 101 in FIG. 7. When the membrane switch 24 is released, the count in the counter 66 is initiated as indicated at 100 in FIG. 7. The count-down timer 66 checks the position of the membrane switch 24 continuously. If the membrane switch 24 is re-depressed before the counter 66 counts down to 0, the system checks the position of a safety switch 112.

In one alternative position of the switch 112, a signal is produced on a line 114 in FIG. 7, the pin 62 continues to be latched as in 98 and the gun continues to be in a ready mode as indicated by the light-emitting diode 28. If the membrane switch 24 is not re-depressed before the counter counts to 0, a signal is produced on a line 104 in FIG. 7 and the pin 62 is actuated to the second or retracted position for preventing the trigger 65 from being depressed. This is indicated at 118 in FIG. 7. In the other alternative positive of the safety switch 112, after the membrane switch 24 has been re-depressed during the count-down time, a signal is produced on a line 116 in FIG. 7 and a repeat of the identification routine is produced as indicated at 92 in FIG. 7.

Figure 8:
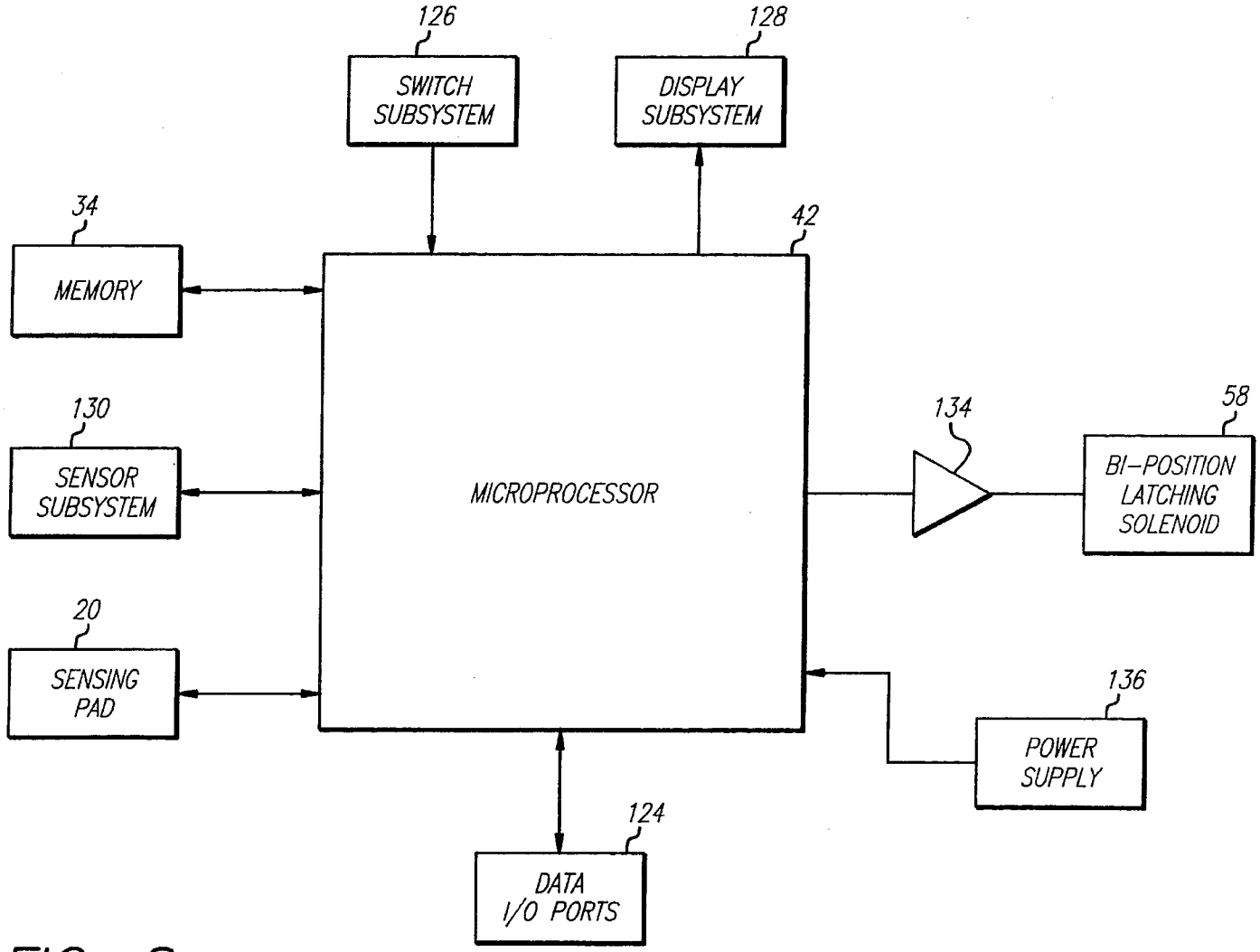
FIG. 8 is a schematic diagram showing in block form the interrelationship between different portions of the gun control system.

FIG. 8 is a system block diagram representing the electrical and electro-mechanical components of the invention. FIG. 8 shows the microcomputer 42 which controls the logic functions of the system. The microcomputer 42 includes a system ROM (read only memory) and a system RAM (random access memory). These memories and the microprocessor 42 execute the program logic functions as described in the flow chart shown in FIG. 9. Also included in the microprocessor 42 are interval timers for keeping track of real-time (e.g. time and calendar day) and delay time (e.g. the amount of time that the membrane switch 24 has been released).

Also included in the microcomputer are I/O (input/output) ports 124. By including these I/O ports, the microprocessor 42 is able to control the operation of, and to communicate with, the different sub-systems shown in FIG. 8. One of these subsystems is the data I/O function which may be provided by external source 81 (FIG. 4) for communicating data into the system from an outside computer such as a computer at a gun service center or communicating data from the gun to the outside computer. This provides for uploading and downloading (sending and receiving) of information in the system.

Illustrated in FIG. 8 is the memory 34 which stores various fingerprints or palmprints and events. These fingerprints correspond to enrolled, and therefore allowable, prints of individuals in which the system will go into the enabled state by bringing the latching solenoid 58 to the state enabling the gun to fire. The memory 34 also stores events such as the time and the date that the gun was fired and the identification based on the fingerprint of the individual firing the gun. Also stored in the memory 34 are fingerprints and the time and the date of the handling and attempted operation of the gun by unauthorized individuals who have picked up the gun. The sensing pad 20 senses the fingerprints or palmprints. The data representing the print is then sent to the microprocessor 42. The microprocessor 42 first selects and commands the sensing pad 20 to read the print.

The data I/O ports 124 receive and translate the data signals to the binary signals readable by the microprocessor 42. The data sent through the data I/O ports 124 to the processor 42 includes information relating to enrollment fingerprint data so that fingerprints can be scanned and enrolled by an external terminal system that is not part of the unit. This is useful to enable controlled enrollment by users operating the terminal system.

The data sent by the microprocessor 42 through the data I/O ports 124 includes both event data and fingerprint/palmprint data. The event data is stored in the memory 34 and comprises events such as when the gun was fired and when the gun was picked up by an unenrolled and therefore unauthorized individual. The fingerprint palm data represents fingerprints/palmprints of both enrolled users and non-enrolled unauthorized individuals who picked up the gun. This data is stored in the memory 34.

A switch subsystem 126 provides data to the microprocessor 42 to determine if the key 41 has been inserted into the slot 40 and to determine the position in which the key is disposed in the barrel 44. The switch system 126 also provides information to determine whether the sensing pad 20 is currently being depressed. This information enables the microprocessor 42 to determine the proper operational and functional state of the key 41 and key barrel 44 in FIG. 2. For example, when the key 41 is in the key barrel 44 and located at position 2 and the sensing pad 20 is depressed, the microprocessor 42 instructs the sensing pad 20 to read the fingerprints/palmprints in the sensing pad 20 and to store such finger prints/palmprints in the memory 34 for the position 2 and to enroll that individual as an authorized user. This is illustrated in the flow chart of FIG. 9.

A display subsystem 128 in FIG. 8 includes, for example, LEDs (such as the lights 28, 30 and 32) indicating to the user the specific state of the gun. This state can be determined by means of a sensor subsystem 130 which can illustratively determine if a bullet is lodged incorrectly in the gun chamber. This can cause the gun not to fire or misfire. The sensor subsystem 130 can include a magnetic coil which can determine the presence of metal such as a bullet that is lodged in an improper position in the chamber.

A driver 134 in FIG. 8 amplifies the logic level signal from the microprocessor 42 to a higher voltage and higher current signal capable of driving the bi-position latching solenoid 58 to one or the other state. The driver 134 can be composed of a transistor array drive device with the higher voltage input derived from a power supply 136. The power supply 136 may be a battery system with voltage regulators and level converters that are well-known in the art.

The bi-position latching solenoid 58 contains a pin that is controllable by the position of the solenoid. The pin enables or disables the operation of the gun. The latching solenoid 58 can be of the magnetic latching type or the mechanical latching type in which two stable positions are achieved. This is important because, during operation, if power were required to be supplied to the solenoid 58, this requirement could drain the battery and prevent the gun from operating during a moment of crisis. By having a bi-position latching solenoid 58, a single pulse to the solenoid causes the pin to become actuated to a particular position without any additional expenditure of power from the power supply 136.

Figure 9:
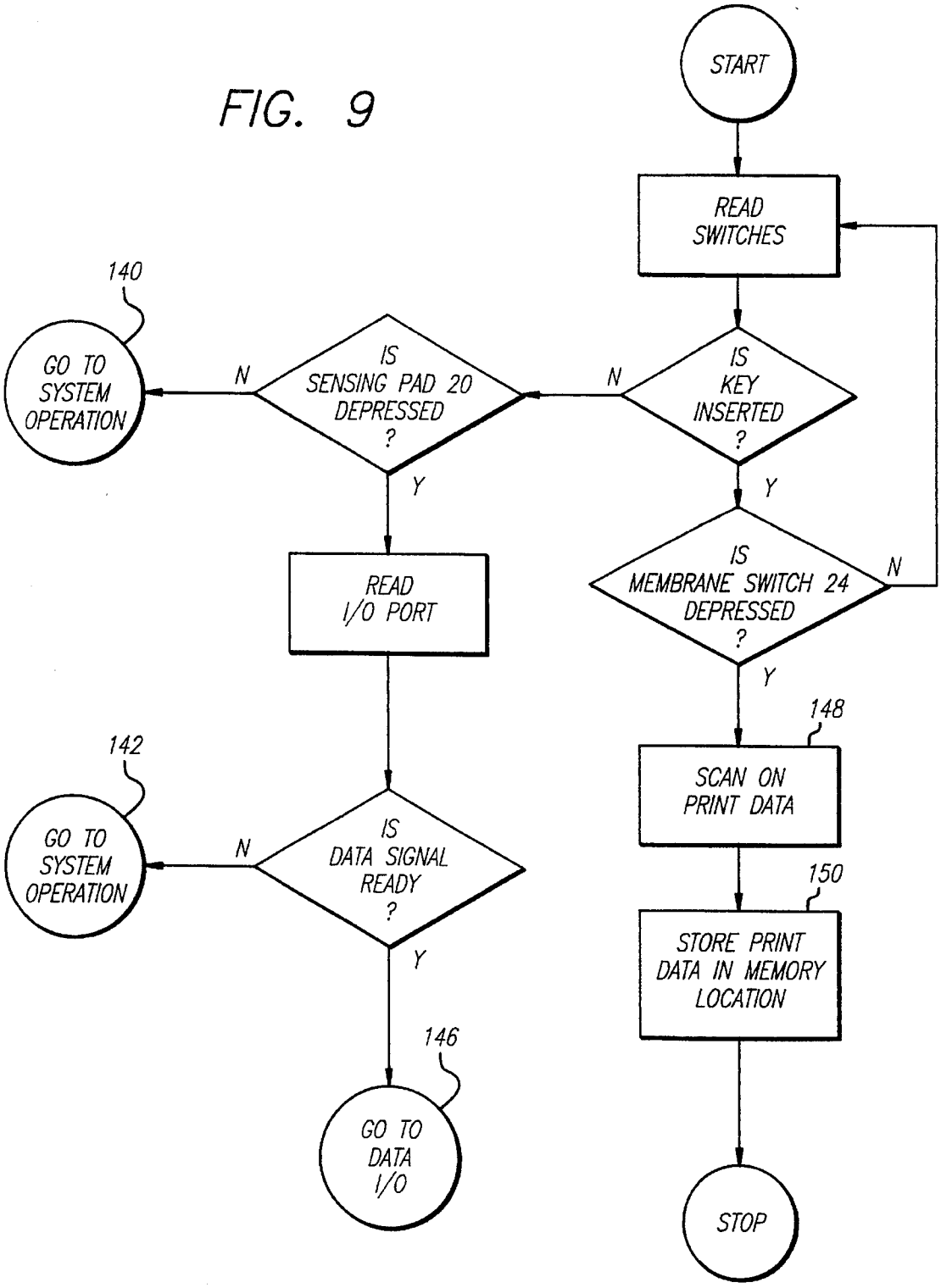
FIG. 9 is a flow chart showing on a schematic basis the operation of the system in recording hand prints of users in the memory and of using these hand prints to control the firing of the gun.

FIG. 9 is a flowchart illustrating the enrollment procedure for reading and storing authorized fingerprints/palmprints. The flowchart operates by first reading the switch array positions of the barrel 44 in FIG. 2. The positions of the switch array are determined by the key 41 and the location (e.g. locations 1, 2 and 3) of the key in the barrel 44. If the key 41 is inserted in the barrel 44 and the sensing pad 20 is depressed, the system will scan the fingerprint/palmprint data and store that data in the particular memory location correlated to the switch position.

If the key is not inserted in the barrel 44 and the sensing pad 20 is depressed and the data signal is not present, the system goes into the system operation 142 as illustrated in the left portion of the flowchart in FIG. 9. (In FIG. 9, an "N" indicates "No" and a "Y" indicates "Yes".) If the key is not inserted in the barrel 44 and the sensing pad 20 is not depressed, the system goes into the system operation 140 in FIG. 9. As will be seen in the left portion of FIG. 9, the system will not operate unless the sensing pad 20 is depressed and the data signal is ready.

If the key is not inserted in the barrel 44 and the membrane switch 24 is depressed and the data signal such as the spacing signal for information from the external source 81 is present on the data port, the system will go into the data I/O operation shown at 146 in FIG. 9. The data I/O operation is understood in the art as a protocol-based communication system in which data at a specified Baud rate is sent between the two communicating systems. The hand print on a sensing pad like the sensing pad 20 is then sensed as at 148 in FIG. 9 and the hand print is recorded in the memory 34 as at 150.

The gun constituting this invention has certain important advantages. It becomes activated instantaneously on a passive basis when an authorized user grips the handle 14 to fire the gun. The gun is accordingly ready to be fired immediately after the authorized user grips the gun. Furthermore, as long as the authorized user is in possession of the gun, the identification of the authorized user cannot be altered since the identification is stored in the memory 34 which is internal to the gun. Even if the authorized user is not in the possession of the gun, the user's identification in the memory 34 cannot be altered as long as the user has the Key 41.

The gun constituting this invention also has other important advantages. For example, when an authorized user has been identified and the gun has been prepared to be fired, the user can relinquish his grip on the gun and then grip the gun again for immediate firing. Provided that the time between the grip relinquishment and the grip tightening occurs within a particular period such as twenty (20) seconds, the authorized user can immediately fire the gun.

There are other important advantages in the gun of this invention. The gun records each time that an authorized user fires the gun. The gun also records the authorized user who has fired the gun. The gun also records the print of each unauthorized user who attempts to fire the gun. The gun further records the time when the unauthorized user attempts to fire the gun.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A gun programmable to provide for its firing only by an authorized person, including, a handle, a trigger, a body supporting the handle and the trigger, an actuatable pin disposed on the body and movable between first and second stable positions and operable in the first stable position to provide for the depression of the trigger to obtain the firing of a bullet from the body and operable in the second stable position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing signals in accordance with the results of such comparison, and third means for actuating the pin to an individual one of the first and second stable positions in accordance with the signals produced by the second means, the third means being operable to maintain the actuatable pin in each of the first and second stable positions until the actuation of the actuatable pin by the third means to the other one of the first and second stable positions.

2. A gun as set forth in claim 1, means on the gun for indicating when the comparing means produces signals representing a coincidence between the prints from the memory means and the first means.

3. A gun programmable to provide for its operation only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing signals in accordance with the results of such comparison, and third means for actuating the pin to an individual one of the first and second positions in accordance with the signals produced by the second means, the second means including means for producing signals with particular characteristics when the prints from the memory means and the first means coincide, the third means including means for actuating the pin to the first position when the second means produces the signal with the particular characteristics, fourth means for updating the comparison by the second means of the print by the first means with the print from the memory means, and fifth means responsive to the failure within a particular period of time of the second means to provide signals with the particular characteristics during the updated comparison for actuating the pin to the second position.

4. A gun programmable to provide for its operation only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing print of such particular portion, second means supported by the gun for comparing the prints from the memory means and the first means and for producing signals in accordance with the results of such comparison, third means for actuating the pin to an individual one of the first and second positions in accordance with the signals produced by the second means, and means for recording the print of a portion of the hand of a person who attempts to fire the gun but whose print is not recorded in the memory means.

5. A gun programmable to provide for its firing only by an authorized person, including, a body portion, a handle extending from the body portion, a trigger extending from the body portion and actuatable from a first position to a second position to obtain a firing of the gun, a pin extending from the body portion and actuatable between first and second positions and operable in the first position to provide for the actuation of the trigger between the first and second positions and operable in the second position to prevent the actuation of the trigger from the first position to the second position, memory means for storing a print of at least a particular portion of the hand of the authorized person, first means disposed on the body for receiving a print of the particular portion of the hand of the person gripping the gun and attempting to fire the gun, second means for comparing the prints in the memory means and the first means and for producing a signal when the prints coincide, third means responsive to the signal from the second means for actuating the pin from the second position to the first position and for latching the pin in the first position, and fourth means responsive to the failure of the first means to receive, in a particular period of time after the actuation of the pin from the second position, a print coinciding with a print in the memory means to the first position for actuating the pin from the first position to the second position and for latching the pin in the second position to prevent the trigger from being actuated from the first position to the second position.

6. In a combination as set forth in claim 5, a solenoid included in the third means for becoming energized upon the production of the signal by the second means and for actuating the pin to the first latched position upon becoming energized.

7. In a combination as set forth in claim 5, switch means having first and second states of operation and actuatable from the first state to the second state upon the disposition of the hand of the user on the body for providing for the operation of the first and second means in determining whether the print of the particular portion of the user's hand coincides with the print stored in the memory means.

8. In a combination as set forth in claim 5, fifth means responsive to a failure of the second means for a particular period of time to find a coincidence between the prints in the memory means and the first means after the production of the signal by the second means and after the release of the handle by the user for actuating the pin to the second position and for latching the pin in the second position.

9. In a combination as set forth in claim 5, fifth means for providing individual illuminations respectively indicating the actuation of the pin to the first position, the disposition of the pin in the second position with the body of the gun being manually gripped and the inability of the gun to fire, with the gun being manually gripped, for reasons other than the non-coincidence between the prints in the storage means and the print provided by the first means.

10. A gun programmable to provide for its firing only by an authorized person, including, a body portion, a handle extending from the body portion, a trigger extending from the body portion and actuatable from a first position to a second position to obtain a firing of the gun, a pin extending from the body portion and actuatable between first and second positions and operable in the first position to provide for the actuation of the trigger between the first and second positions and operable in the second position to prevent the actuation of the trigger from the first position to the second position, memory means for storing a print of a particular portion of the hand of the authorized person, first means disposed on the handle for transferring a print of the particular portion of the hand of the authorized person to the memory means when the authorized person grips the handle to fire the gun, second means having first and second states of operation and operative in the first state for providing for a transfer by the first means of the print of the particular portion of the hand of the authorized person to the memory means and operative in the second state to prevent a transfer by the first means of the print of the particular portion of the hand of the authorized user to the memory means, and third means associated with the second means for providing for an operation of the second means in the first state at first particular periods of time and for providing for an operation of the second means in the second state at second particular periods of time different from the first particular period of time.

11. A gun as set forth in claim 10, including, third means operative upon the transfer by the first means of the print of the particular portion of the hand of the authorized person into the memory means and upon a subsequent gripping of the handle by the hand of the authorized person for comparing the print resulting from such gripping and the print recorded in the memory means to actuate the pin to the first position upon a coincidence in such comparison.

12. In a gun as set forth in claim 11, fourth means for preventing an actuation of the pin by the third means to the first position if there is no coincidence in the comparison by the third means of the print recorded by the first means in the memory means and the print produced by a subsequent gripping of the handle by a user other than the authorized user.

13. A gun programmable to provide for its firing only by an authorized person, including, a body portion, a handle extending from the body portion, a trigger extending from the body portion and actuatable from a first position to a second position to obtain a firing of the gun, a pin extending from the body portion and actuatable between first and second positions and operable in the first position to provide for the actuation of the trigger between the first and second positions and operable in the second position to prevent the actuation of the trigger from the first position to the second position, memory means for storing a print of a particular portion of the hand of the authorized person, first means disposed on the handle for transferring a print of the particular portion of the hand of the authorized person to the memory means when the authorized person grips the handle to fire the gun, second means having first and second states of operation and operative in the first state for providing for a transfer by the first means of the print of the particular portion of the hand of the authorized person to the memory means and operative in the second state to prevent a transfer by the first means of the print of the particular portion of the hand of the authorized user to the memory means, the second means being disposed on the handle and including a cavity for receiving a key, the cavity and the key defining a switch which is closed upon the insertion of the key into the cavity and which provides, upon such switch closure, for the transfer of the print of the particular portion of the hand of the authorized person from the first means to the memory means.

14. A gun programmable to provide for its firing only by an authorized person, including a body portion, a handle extending from the body portion, a trigger extending from the body portion and actuatable from a first position to a second position to obtain a firing of the gun, a pin extending from the body portion and actuatable between first and second positions and operable in the first position to provide for the actuation of the trrigger between the first and second positions and operable in the second position to prevent the actuation of the trigger from the first position to the second position, memory means for storing a print of a particular portion of the hand of the authorized person, first means disposed on the handle for transferring a print of the particular portion of the hand of the authorized person to the memory means when the authorized person grips the handle to fire the gun, and second means for providing for a transfer by the first means of the print of the particular portion of the hand of the authorized person from the first means to the memory means, third means operative upon the transfer by the first means of the print of the particular portion of the hand of the authorized person by the second means into the memory means and upon a subsequent gripping of the handle by the hand of the authorized person for comparing the print resulting from such gripping and the print recorded in the memory means to actuate the pin to the first position upon a coincidence in such comparison, fourth means for preventing an actuation of the pin by the third means to the first position if there is no coincidence in the comparison by the third means of the prints recorded by the first means in the memory means and the prints produced by a gripping of the handle by a user other than the authorized user, fifth means for retaining the print of the attempted user of the gun when there is no coincidence between the print in the memory means and the print produced on the handle by the user other than the authorized user.

15. A gun programmable to provide for its firing only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing the print of a particular portion of the hand of the authorized person, first means for comparing the print in the memory means and the print on the handle of the particular portion of the hand of a person gripping the gun and for actuating the pin from the second position to the first position when there is a coincidence in such comparison, and second means for storing the print of the particular portion of the person gripping the gun when there is no coincidence in the comparison provided by the user.

16. A gun as set forth in claim 15 wherein the second means includes means for storing the date and time of the attempted use of the gun by the person gripping the gun.

17. A gun as set forth in claim 15, including, third means for obtaining a return of the pin to the second position if there is no coincidence for a particular period of time between the print in the memory means and any print in the handle after the handle has been released by the authorized person.

18. A gun as set forth in claim 15, including, third means for initiating successive comparisons by the first means upon a coincidence in the comparison of prints by the first means and the release of the handle by the authorized person for providing a count of the time of no such coincidence from the time of the last previous occurrence of coincidence and for reinstituting such count when such a coincidence reoccurs within a particular period of time after the initiation of the period of no such coincidence.

19. A gun programmable to provide for its firing only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing a signal representing a substantial coincidence in such comparison, third means responsive to the signal representing the substantial coincidence in the comparison for actuating the pin to the first position, fourth means for providing a comparison by the second means of the prints from the memory means and the first means, after the handle has been released by the authorized person, to determine if such coincidence in the comparison is being maintained, fifth means operatively coupled to the fourth means for determining the time that there is no coincidence in the comparison provided by the fourth means, and sixth means operatively coupled to the fifth means for actuating the pin to the second position when the fifth means provides a determination that no such coincidence has occur red for a particular time period after there is no coincidence in the comparison provided by the fourth means.

20. A gun as set forth in claim 19, including, seventh means for replacing the print in the memory means of the particular portion of the hand of the authorized user with a print of the particular portion of the hand of a person desiring to become authorized in using the gun.

21. A gun as set forth in claim 19, including, seventh means for indicating in the memory means whether the print of the particular portion of the hand of a person grasping the gun coincides with the print of the authorized person in the memory means.

22. A gun programmable to provide for its firing only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing a signal representing a substantial coincidence in such comparison, third means for providing a comparison by the second means of the prints from the memory means and the first mean, after the handle has been released by the authorized person, to determine if such coincidence in the comparison is being maintained, fourth means for actuating the pin to the second position if no such coincidence occurs for a particular time period after the handle has been released by the authorized user, and fifth means responsive to the comparison from the third means for recording in the memory means the print of the particular portion of the hand of the person handling the gun if the comparison does not indicate the coincidence between the prints from the memory means and the first means.

23. A gun programmable to provide for its operation only by an authorized person, including, a handle, a trigger, a body supporting the handle and the triqger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing a signal representing a substantial coincidence in such comparison, third means for providing a comparison by the second means of the prints from the memory means and the first means, after the handle has been released by the authorized person, to determine if such coincidence in the comparison is being maintained, fourth means for actuating the pin to the second position if no such coincidence occurs for a particular time period after the handle has been released by the authorized user, and fifth means for recording in the memory means the time of any firing of the gun and the time of any handling of the gun by a non-authorized person.

24. A gun programmable to provide for its firing only by an authorized user, including, a handle, a trigger, a body supporting the handle and the trigger, memory means for storing the print of a particular portion of the hand of the authorized user, switching means actuatable by the hand of the user when the user grasps the gun, sensing means for sensing the print of the particular portion of the hand of the person using the gun, first means having first and second stable states for preventing the firing of the gun in the first stable state and for providing for the firing of the gun in the second stable state, and second means operative upon the actuation of the switching means by the hand of the user for comparing the print in the memory means and the print in the sensing means and for providing for the operation of the first means in the second stable state when the prints in the memory means and the sensing means coincide and for providing for the operation of the first means in the first stable state when the prints in the memory means and the sensing means do not coincide, the first means being operative in an individual one of the first and second stable states until an operation of the first means by the second means to the other one of the first and second stable states.

25. In a combination as set forth in claim 24, means for providing for the recording of the print of the hand of the authorized user in the memory means, when the authorized user initially grips the handle of the gun, provide a subsequent comparison between the print in the memory means of the hand of the authorized user and the print of the hand of a user who is attempting to fire the gun.

26. A gun programmable to provide for its firing only by an authorized user, including, a handle, a trigger, a body supporting the handle and the trigger, memory means for storing the print of a particular portion of the hand of the authorized user, switching means actuatable by the hand by the user, sensing means for sensing the print of the particular portion of the hand of the person using the gun, first means operative upon the actuation of the switching means by the user for comparing the print in the memory means and the print in the sensing means and for providing for the actuation of the trigger when the prints in the memory means and the sensing means coincide, and second means for recording the print of the particular portion of the hand of the user in the memory means, when the user actuates the trigger to fire the gun, to indicate such actuation of the trigger by the user.

27. In a combination as set forth in claim 26, means for recording the date and the time that the user actuates the trigger to fire the gun.

28. A gun programmable to provide for its firing only by an authorized user, including, a handle, a trigger, a body supporting the handle and the trigger, memory means for storing the print of a particular portion of the hand of the authorized user, switching means actuatable by the hand by the user, sensing means for sensing the print of the particular portion of the hand of the person using the gun, first means operative upon the actuation of the switching means by the user for comparing the print in the memory means and the print in the sensing means and for providing for the actuation of the trigger when the prints in the memory means and the sensing means coincide, the first means being operative to prevent the trigger from being actuated when the prints in the sensing means and the memory means do not coincide, means for recording the print of the particular portion of the hand of the user when the prints in the sensing means and the memory means do not coincide, and means for recording the date and the time that such user unsuccessfully attempts to fire the gun.

29. A gun programmable to provide for its firing only by an authorized user, including, a handle, a trigger, a body supporting the handle and the trigger, memory means for storing the print of a particular portion of the hand of the authorized user, sensing means for sensing the print of the particular portion of the hand of the person using the gun, switching means actuatable at the handle by the user, first means operative upon the actuation of the switching means by the user for comparing the print in the memory means and the print in the sensing means and for providing for the actuation of the trigger when the prints in the memory means and the sensing means coincide, second means for counting a particular time, third means responsive to the operation of the first means in providing for the actuation of the trigger for thereafter energizing the second means to obtain a count by the second means of the time after the actuation of the switching means is discontinued, and fourth means responsive to the count of the particular time by the second means for operating upon the first means to prevent the trigger from being actuated.

30. In a combination as set forth in claim 29, fifth means for resetting the second means to provide for an initiation of a new count of the particular time when the user actuates the switching means before the count of the particular time by the second means.

31. In a combination as set forth in claim 29, fifth means for providing for the actuation of the trigger by an authorized user when the authorized user actuates the switching means before the count by the second means of the particular time.

32. In a combination as set forth in claim 29, fifth means operable in a first relationship to provide for an actuation by the authorized user of the trigger and operable in a second relationship to prevent an actuation by a user other than the authorized user of the trigger, the fifth means being normally disposed in the second operative relationship, and the fifth means including sixth means for changing the operation of the fifth means from the second operative relationship to the first operative relationship when the prints in the memory means and the sensing means coincide.

33. In a combination as set forth in claim 32, the fifth means including seventh means for changing the sixth means from the first operative relationship to the second operative relationship when the second means counts the particular time.

34. In a combination as set forth in claim 33, eighth means for providing for another operation of the first means when the authorized user actuates the switching means before the count by the second means of the particular time, the first means including ninth means operative upon the re-actuation of the switching means by the authorized user for comparing the print in the memory means and the print in the sensing means and for providing for the actuation of the trigger when the prints in the memory means and the sensing means coincide.

35. In a combination as set forth in claim 34, the first means being operative to prevent the actuation of the trigger when the prints in the memory means and the sensing means do not coincide upon the re-actuation of the switching means by the user.

36. A programmable gun to provide for its firing only by an authorized user, including, a handle in the gun, memory means in the gun for storing the print on the handle of the gun of the hand of an authorized user, first means for sensing the print of the hand of the authorized user when the authorized user grasps the handle of the gun, second means provided in the gun and having a first operative relationship for transferring the print of the hand of the authorized user into the memory means upon the grasping of the handle by the hand of the authorized user and having a second relationship for preventing such a transfer, and third means operative in the first relationship of the second means for transferring the print of the hand of the authorized user into the memory means upon the grasping of the handle by the hand of the authorized user, and fourth means operatively coupled to the second means for providing an operation of the second means in the first relationship at first particular times and for providing an operation of the second means in the second relationship at second particular times different from the first particular times.

37. A gun as set forth in claim 36, including, the second means including a switch disposed in the gun and having a closed state defining the first operative relationship and an open state defining the second operative relationship, and the fourth means being operative to close the switch at the first particular times and to open the switch at the second particular times.

38. A gun as set forth in claim 36, including, the second means including a switch disposed in the handle of the gun and having a closed state defining the first operative relationship and having an open state defining the second operative relationship and including a member movable to a first position providing the closed state of the switch and to a second position providing the open state of the switch, and the fourth means being positionable in the handle to move the member to selective ones of the first and second positions.

39. A gun is set forth in claim 36, including, fifth means for sensing the print subsequently provided on the handle by the hand of a proposed user after the transfer of the print of the hand of the authorized user into the memory means, and sixth means for comparing the hand print provided by the fifth means and the hand print in the memory means to determine a coincidence between such hand prints.

40. A gun as set forth in claim 39, including, seventh means for readying the gun to be fired when the sixth means determines from the comparison that there is a coincidence between the hand prints being compared.

41. A gun as set forth in claim 40, including, the second means including a switch disposed in the handle of the gun and having a closed state defining the first operative relationship and having an open state defining the second operative relationship and including a member movable to a first position providing the closed state of the switch and to a second position providing the open state of the switch and the fourth means being positionable in the handle to move the member to selective ones of the first and second positions.

42. A gun programmable to provide for its firing only by an authorized user, including, memory means for storing the print of the hand of the authorized user, first means for sensing the print of the hand of the authorized user when the hand of the authorized user grasps the gun, a trigger, second means having a first stable state of operation and a second stable state of operation and operative in the first state to provide for the actuation of the trigger by the authorized user and operative in the second state to prevent the actuation of the trigger by a user other than the authorized user, third means for comparing the hand print in the memory means and the hand print sensed by the first means, fourth means responsive to the comparison by the third means for operating the second means to a selective one of the first and second stable states, and fifth means included in the fourth means for maintaining the operation of the second means in each of the first and second stable states of operation without the introduction of any energy to the second means and the fourth means until the operation of the second means by the fourth means to the other one of the first and second states of operation.

43. A gun programmable to provide for its firing only by an authorized user, including, memory means for storing the print of the hand of the authorized user, first means for sensing the print of the hand of the authorized user when the hand of the authorized user grasps the gun, a trigger, second means having a first stable state of operation and a second stable state of operation and operative in the first state to provide for the actuation of the trigger by the authorized user and operative in the second state to prevent the actuation of the trigger by a user other than the authorized user, third means for comparing the hand print in the memory means and the hand print sensed by the first means, fourth means responsive to the comparison by the third means for operating the second means to a selective one of the first and second stable states, and fifth means for recording in the memory means the print of the hand of a proposed user when the proposed user grasps the gun to fire the gun.

44. A gun programmable to provide for its firing only by an authorized user, including, memory means for storing the print of the hand of the authorized user, first means for sensing the print of the hand of the authorized user when the hand of the authorized user grasps the gun, a trigger, second means having a first stable state of operation and a second stable state of operation and operative in the first state to provide for the actuation of the trigger by the authorized user and operative in the second state to prevent the actuation of the trigger by a user other than the authorized user, third means for comparing the hand print in the memory means and the hand print sensed by the first means, and fourth means responsive to the comparison by the third means for operating the second means to a selective one of the first and second stable states, fifth means operative in a first relationship to provide for the storage in the memory means of the print of the hand of the authorized user and operative in a second relationship to prevent the storage in the memory means of the print of the hand of a proposed user, sixth means responsive to the operation of the fifth means in the first relationship for transferring into the memory means the print of the hand of the authorized user when the authorized user grasps the gun, and seventh means operatively coupled to the fifth means for providing for an operation of the fifth means in the first relationship at first particular times and for an operation of the fifth means in the second relationship at second particular times different from the first particular times.

45. A gun programmable to provide for its firing only by an authorized user, including, memory means for storing the print of the hand of the authorized user, first means for sensing the print of the hand of the authorized user when the hand of the authorized user grasps the gun, a trigger, second means having a first stable state of operation and a second stable state of operation and operative in the first state to provide for the actuation of the trigger by the authorized user and operative in the second state to prevent the actuation of the trigger by a user other than the authorized user, third means for comparing the hand print in the memory means and the hand print sensed by the first means, and fourth means responsive to the comparison by the third means for operating the second means to a selective one of the first and second stable states, and a source of electrical energy, the fourth means being operatively coupled to the source of electrical energy to operate the second means to the selective one of the first and second states, the second means being operative in the selective one of the first and second states without any additional energy from the source while the second means remains in such selective one of the first and second states.

46. A gun as set forth in claim 45, including, fifth means operative in a first relationship to provide for the storage in the memory means of the print of the hand of the authorized user and operative in a second relationship to prevent the storage in the memory means of the print of the hand of a proposed user, sixth means responsive to the operation of the fifth means in the first relationship for transferring into the memory means the print of the hand of the authorized user when the authorized user grasps the gun, and seventh means operatively coupled to the fifth means for providing for an operation of the fifth means in the first relationship at first particular times and for an operation of the fifth means in the second relationship at second particular times different from the first particular times.

47. A gun programmable to provide for its firing only by an authorized user, including, memory means for storing the print of the hand of the authorized user, first means for sensing the print of the hand of the authorized user when the hand of the authorized user grasps the gun to fire the gun, a trigger, second means for comparing the hand print in the memory means and the hand print sensed by the first means, third means responsive to the results of the comparison by the third means for activating the gun to obtain a firing of the gun by the authorized user when the second means indicates a coincidence between the hand print in the comparing means and the hand print sensed by the first means, and fourth means responsive to the activation of the gun by the third means for maintaining the activation of the gun by the third means during the grasping of the gun by the authorized user and for a particular period of time after the authorized user ceases to grasp the gun.

48. A gun as set forth in claim 47, including, the fourth means including fifth means for obtaining a discontinuance of the activation of the gun by the fourth means when a person other than the authorized user grasps the gun.

49. A gun as set forth in claim 48, including, the fourth means including fifth means for obtaining a discontinuance of the activation of the gun by the fourth means when a person other than the authorized user grasps the gun, and sixth means for recording in the memory means the firing of the gun by the authorized user and the time of such firing and the hand print of the authorized user at the time of such firing.

50. A gun as set forth in claim 47, including, fifth means for recording in the memory means the firing of the gun by the authorized user and the time of such firing and the hand print of the authorized user at the time of such firing.

51. A gun as set forth in claim 47, including, fifth means for providing a count of the time after the authorized user ceases to grasp the gun, and sixth means for restarting the count by the fifth means of the time when the authorized user again grasps the gun before the end of the particular period of time.

52. A method of controlling the firing of a gun by an authorized user, including the steps of:

sensing in the gun the hand print of a person gripping a handle on the gun, comparing in the gun the sensed hand print with the hand print recorded in a memory of the authorized user, actuating a bistable member in the gun from a first position to a second position upon a coincidence between the sensed hand print and the hand print in the memory, and providing for the firing of the gun by the authorized user while the bistable member is in the second position, and maintaining the bistable member in each of the first and second positions without introducing any energy to the bistable member to maintain the bistable member in such position until the bistable member is actuated to the other one of the first and second positions.

53. A method as set forth in claim 52 wherein the bistable member is actuated from the second position to the first position when the authorized user no longer grasps the gun.

54. A method of controlling the firing of a gun by an authorized user, including the steps of:

sensing in the gun the hand print of a person gripping a handle on the gun, comparing in the gun the sensed hand print with the hand print recorded in a memory of the authorized user, actuating a bistable member in the gun from a first position to a second position upon a coincidence between the sensed hand print and the hand print in the memory, and providing for the firing of the gun by the authorized user while the bistable member is in the second position, wherein the bistable member is responsive to energy from an electrical source in the gun to become actuated from the first position to the second position upon the coincidence between the sensed hand print and the hand print in the memory and wherein no energy is provided from the electrical source to retain the bistable member in the second position after the actuation of the bistable member to the second position and until the actuation of the bistable member to the first position.

55. A method as set forth in claim 54 wherein the bistable member is actuated from the second position to the first position by electrical energy from the source when the authorized user no longer grasps the gun and wherein no energy from the source is provided to retain the bistable member in the first position and wherein the gun cannot be fired with the bistable member in the first position.

56. A method of controlling the firing of a gun by an authorized user, including the steps of:

providing a memory in the gun for storing the hand print of the authorized user, providing in the gun for the recording of the hand print of the authorized user in the memory, sensing the hand print of the authorized user when the authorized user grips the gun after the provision in the gun for the recording of the hand print of the authorized user in the memory, recording the sensed hand print in the memory after the provision in the gun for the recording of the hand print of the authorized user in the memory, and recording in the memory the hand print of each individual who attempts, either successfully or unsuccessfully, to fire the gun.

57. A method of controlling the firing of a gun by an authorized user, including the steps of:

providing a memory in the gun for storing the hand print of the authorized user, providing in the gun for the recording of the hand print of the authorized user in the memory, sensing the hand print of the authorized user when the authorized user grips the gun after the provision in the gun for the recording of the hand print of the authorized user in the memory, and recording the sensed hand print in the memory after the provision in the gun for the recording of the hand print of the authorized user in the memory, sensing the hand print of a person grasping the gun after the recording of the hand print of the authorized user in the memory, comparing the hand print of the authorized user in the memory and the hand print of the person grasping the gun after the recording of the hand print of the authorized user in the memory to determine if there is any coincidence between such hand prints, providing for the firing of the gun by the proposed user when the comparison indicates that the proposed user is the authorized user, providing for the firing of the gun by the proposed user including the step of actuating a bistable member from a first position preventing the firing of the gun by the proposed user to a second position providing for the firing of the gun by the proposed user, recording in the memory the hand print of each individual who attempts, either successfully or unsuccessfully, to fire the gun, and eliminating the provision in the gun for the recording of the hand print of the authorized user in the memory after such recording.

58. A method of controlling the firing of a gun by an authorized user, including the steps of:

providing in a memory in the gun the hand print of an authorized user, sensing the hand print of a proposed user who grasps the gun, comparing the hand print of the authorized user in the memory and the hand print of the proposed user to determine if there is any coincidence, enabling the gun to be fired when there is a coincidence in the comparison, determining the time after the authorized user releases his grasp of the gun, and disabling the gun from being fired after a determination that the authorized user has released his grasp of the gun for a particular period of time.

59. A method as set forth in claim 58, including the steps of:

providing for a continuation in the enabling of the gun to be fired when a determination is made that the authorized user has again grasped the gun within the particular period of time after the authorized user has release d the grasp of the gun.

60. A method as set forth in claim 58 wherein the gun becomes disabled immediately after the authorized user releases the grasp of the gun and a person other than the authorized user grasps the gun even when the grasping of the gun by the person other than the authorized user occurs within the particular period of time after the authorized user releases the grasp of the gun.

61. A method as set forth in claim 58 wherein the gun is enabled to be fired by moving a bistable member from a first position preventing the gun from being fired to a second position enabling the gun to be fired.

62. A method as set forth in claim 61 wherein the bistable member is moved from the second position to the first position to disable the gun immediately after the authorized user releases the gun and a person other than the authorized user grasps the gun even when the grasping of the gun by the person other than the authorized user occurs within the particular period of time after the authorized user releases the grasp of the gun.

63. A gun programmable to provide for its firing only by an authorized person, including, a handle, a trigger, a body supporting the handle and the trigger, an actuatable pin disposed on the body and movable between first and second positions and operable in the first position to provide for the depression of the trigger to obtain the firing of a bullet from the body and operable in the second position to restrain the trigger from becoming depressed, memory means for storing prints identifying a particular portion of the hand of the authorized person, first means disposed on the handle for receiving the particular portion of the hand of the user and for producing a print of such particular portion, second means supported by the gun for comparing the prints from the memory means and the first means and for producing a signal representing a substantial coincidence in such comparison, third means responsive to the signal representing the substantial coincidence in the comparison for actuating the pin to the first position, fourth means for providing a comparison by the second means of the prints from the memory means and the first means, after the handle has been released by the authorized person, to determine if such coincidence in the comparison is being maintained, fifth means for actuating the pin to the second position if no such coincidence occurs for a particular time period after the handle has been released by the authorized user, and sixth means for indicating in the memory means the print of the particular portion of the hand of a person firing or attempting to fire the gun and the time of such firing or attempted firing.

* * * * *